US010946258B1

(12) United States Patent
Isgar

(10) Patent No.: US 10,946,258 B1
(45) **Date of Patent: *Mar. 16, 2021**

(54) ADJUSTABLE GRIP

(71) Applicant: Charles Isgar, Scottsdale, AZ (US)

(72) Inventor: Charles Isgar, Scottsdale, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/565,809

(22) Filed: Sep. 10, 2019

Related U.S. Application Data

(63) Continuation of application No. 16/381,785, filed on Apr. 11, 2019, now Pat. No. 10,589,156, which is a continuation of application No. 16/014,997, filed on Jun. 21, 2018, now Pat. No. 10,300,359.

(60) Provisional application No. 62/618,906, filed on Jan. 18, 2018.

(51) Int. Cl.

| | |
|---|---|
| ***A63B 53/14*** | (2015.01) |
| ***A63B 60/22*** | (2015.01) |
| ***A63B 53/00*** | (2015.01) |
| *A63B 60/26* | (2015.01) |
| *A63B 60/30* | (2015.01) |
| *A63B 60/32* | (2015.01) |
| *A63B 60/20* | (2015.01) |
| *A63B 60/14* | (2015.01) |

(52) U.S. Cl.
CPC ..... *A63B 60/22* (2015.10); *A63B 53/007* (2013.01); *A63B 53/14* (2013.01); *A63B 60/14* (2015.10); *A63B 60/20* (2015.10); *A63B 60/26* (2015.10); *A63B 60/30* (2015.10); *A63B 60/32* (2015.10)

(58) Field of Classification Search
CPC ..... A63B 53/16; A63B 53/14; A63B 53/007; A63B 2053/022; A63B 60/22; A63B 60/26; A63B 60/10; A63B 60/30; A63B 60/32; A63B 60/14; A63B 60/20
USPC ..... 473/313, 300, 302, 303
See application file for complete search history.

(56) References Cited

U.S. PATENT DOCUMENTS

| | | | | |
|---|---|---|---|---|
| 2,225,839 | A * | 12/1940 | Moore, Jr. | A63B 53/14 473/295 |
| 3,804,413 | A | 4/1974 | Hrivnak | |
| 3,834,714 | A | 9/1974 | Smolinski | |
| 5,586,946 | A * | 12/1996 | Haber | A63B 53/14 473/295 |
| 7,510,483 | B2 | 3/2009 | Tremulis et al. | |
| 8,944,929 | B1 | 2/2015 | Smith | |
| 10,300,359 | B1 * | 5/2019 | Isgar | A63B 60/22 |
| 2001/0041626 | A1 | 11/2001 | Madelle | |
| 2003/0036436 | A1 | 2/2003 | Casanova, Jr. et al. | |
| 2005/0079924 | A1 | 4/2005 | Heinecke | |

(Continued)

*Primary Examiner* — Benjamin Layno
(74) *Attorney, Agent, or Firm* — Schmeiser, Olsen & Watts LLP

(57) ABSTRACT

Provided is an adjustable putter grip. The adjustable putter grip includes a first grip member coupled adjacent a first end of a putter shaft. A putter head is coupled to a second end of the putter shaft. The adjustable putter grip also includes a second grip member coupled to the putter shaft between the first grip member and the second end of the putter shaft. The first grip member and the second grip member are rotatable with respect to each other to adjust grip position, the second grip member is rotatable with respect to the first grip member to adjust grip position, or the first grip member is rotatable with respect to the second grip member to adjust grip position. A method of forming a custom grip or custom fitting of a golfer is also disclosed.

5 Claims, 12 Drawing Sheets

(56) References Cited

U.S. PATENT DOCUMENTS

| | | | |
|---|---|---|---|
| 2005/0197201 | A1 | 9/2005 | Schoeninger |
| 2006/0094525 | A1 | 5/2006 | Hung |
| 2007/0079914 | A1 | 4/2007 | Larson |
| 2008/0200288 | A1 | 8/2008 | Phelan |
| 2010/0041489 | A1 | 2/2010 | Elmer |
| 2010/0151975 | A1 | 6/2010 | Hisle et al. |
| 2011/0224012 | A1 | 9/2011 | Hashimoto et al. |
| 2014/0066221 | A1 | 3/2014 | Chen |
| 2016/0287956 | A1 | 10/2016 | Wang |
| 2017/0151475 | A1 | 6/2017 | Krouse |
| 2018/0117432 | A1 | 5/2018 | Aliberti et al. |
| 2020/0023252 | A1 | 1/2020 | Zmuda |

* cited by examiner

ADJUSTABLE GRIP

CROSS REFERENCE TO RELATED APPLICATION[S]

This application is a continuation of U.S. Patent Application entitled "ADJUSTABLE GRIP," Ser. No. 16/381,785, filed Apr. 11, 2019, now U.S. Pat. No. 10,589,156, which is a continuation of U.S. Patent Application entitled "ADJUSTABLE PUTTER GRIP," Ser. No. 16/014,997, filed Jun. 21, 2018, now U.S. Pat. No. 10,300,359, which claims priority to U.S. Provisional Patent Application entitled "PUTTER GRIP," Ser. No. 62/618,906, filed Jan. 18, 2018, the disclosure of which is hereby incorporated entirely herein by reference.

BACKGROUND OF THE INVENTION

Technical Field

This invention relates generally to a golf putter grip and more particularly to a putter with an adjustable grip.

State of the Art

There are numerous types of grips that can be installed on a putter. While conventional putter grips have different sizes and shapes, they are all maintained in a fixed position on the shaft of a putter requiring a fixed parallel grip. These conventional putter grips do not allow for any modification to the grip to adjust for anatomical variances by having variable grip positions that are more natural to enable the golfer to have a more comfortable and better swing of the putter. With these conventional putter grips, the golfer must adjust his or her holding of the straight putter grip without being able to accommodate their unique hand angle orientation.

Accordingly, there is a need for an improved putter grip that is adjustable to account for anatomical variances in golfers.

DISCLOSURE OF THE INVENTION

The present invention relates to an adjustable putter grip for a multitude of custom grip positions for every golfer. This invention allows the golfer to adjust the orientation of the grip to allow either hand to pronate or supinate as desired. Splitting of the grip allows changing the orientations of the hands. The invention further provides for an anatomically, ergonomically adjustable putter grip. Variability of grip accommodates a wide spectrum of anatomical variations in human arms, wrists and hands.

An embodiment includes an adjustable putter grip comprising: a first grip member removably coupled adjacent a first end of a putter shaft, wherein a putter head is coupled to a second end of the putter shaft; a second grip member removably coupled to the putter shaft between the first grip member and the second end of the putter shaft, wherein the first grip member and the second grip member are independently rotatable with respect to each other; and a securing device for securing the first grip member and the second grip member in a desired orientation.

Another embodiment includes a first grip member coupled adjacent a first end of a putter shaft, wherein a putter head is coupled to a second end of the putter shaft; a second grip member coupled to the putter shaft between the first grip member and the second end of the putter shaft, wherein an orientation of the first grip member with respect to the second grip member is adjustable to adjust a grip position; and a securing device for securing the first grip member and the second grip member in a desired orientation.

Further, another embodiment includes an adjustable putter grip comprising: a first grip member coupled adjacent a first end of a putter shaft, wherein a putter head is coupled to a second end of the putter shaft; and a second grip member coupled to the putter shaft between the first grip member and the second end of the putter shaft, wherein the first grip member is rotatable with respect to the second grip member to adjust grip position.

An embodiment includes a method of use of an adjustable grip for forming a custom grip, the method comprising: independently pronating or supinating portions of a putter grip in a desired position for holding by a golfer's hands; forming a customized grip corresponding to the desired position of the first and second grip members; and maintaining the custom grip on a shaft of a putter.

An embodiment includes an adjustable customized putter grip comprising: a first grip member; a second grip member; and a twist point coupled between the first grip member and the second grip member, wherein: the first grip member and the second grip member are rotated with respect to each other utilizing the twist point to a golfer-determined orientation at customized angles of rotation; and the first grip member, the second grip member and the twist point are coupled to a shaft of a putter and the first grip member, the second grip member and the twist point are secured in the golfer-determined orientation.

Another embodiment includes an adjustable customized putter grip comprising: a first grip member; a second grip member; and a twist point coupled between the first grip member and the second grip member, wherein: the first grip member, the second grip member and the twist point are coupled to a shaft of a putter; and the first grip member and the second grip member are rotated with respect to each other utilizing the twist point to a golfer-determined orientation at customized angles of rotation and the first grip member, the second grip member and the twist point are secured in the golfer-determined orientation.

Further, an embodiment includes an adjustable putter grip comprising: a first grip member coupled adjacent a first end of a putter shaft, wherein a putter head is coupled to a second end of the putter shaft; a second grip member coupled to the putter shaft in a position between the first grip member and the second end of the golf club shaft, wherein an orientation of the first grip member with respect to the second grip member is adjustable to adjust a grip position; and a securing device for securing the first grip member and the second grip member in a desired orientation, wherein the securing device includes the first grip member comprising a first portion of the securing device and the second grip member comprising a second portion of the securing device, wherein the first portion of the securing device engages and disengages the second portion of the securing device to maintain the orientation of the first grip member with respect to the second grip member when engaged and allow rotation of the first grip member and the second grip member with respect to each other when disengaged.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

As discussed above, embodiments of the present invention relate to an adjustable putter grip for adjusting grip position. This invention allows each hand to have a different orientation to the putter shaft. Splitting of the grip allows changing the orientations of the hands. The invention further provides for an anatomically, ergonomically adjustable putter grip. Variability of grip accommodates all human hands.

Figure 1:
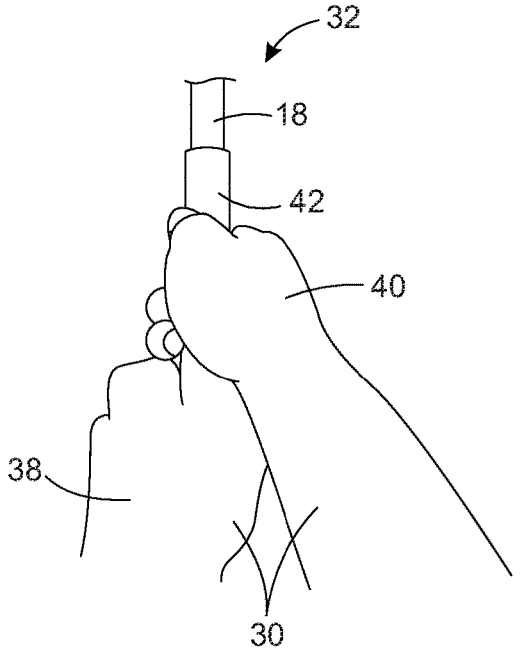
FIG. 1 is a perspective view of a neutral grip position of a golfer's hands on a putter grip according to an embodiment.
Figure 2:
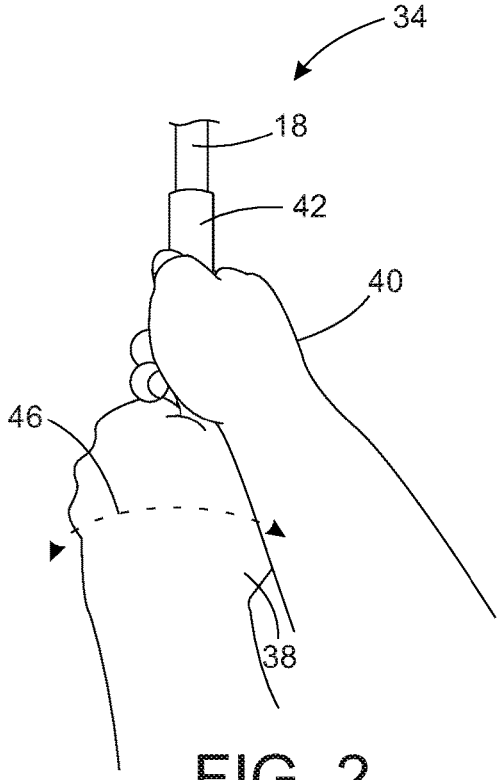
FIG. 2 is a perspective view of a grip position of a golfer's hands on a putter grip with the left hand pronated according to an embodiment.
Figure 3:
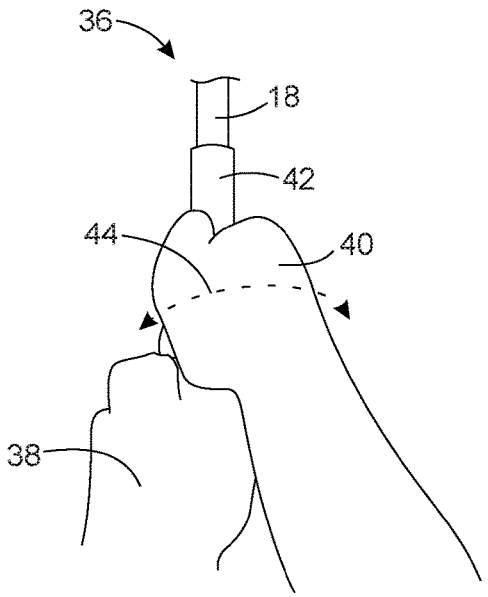
FIG. 3 is a perspective view of a grip position of a golfer's hands on a putter grip with the right hand pronated according to an embodiment.
Figure 4:
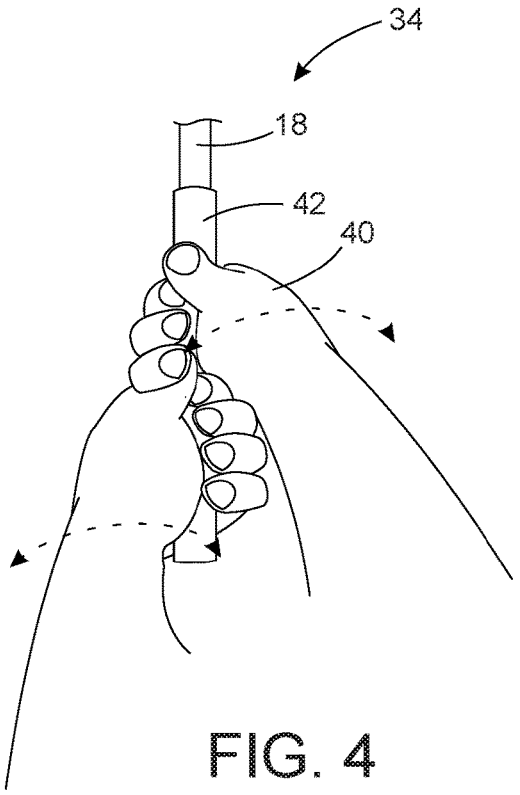
FIG. 4 is a perspective view of a grip position of a golfer's hands on a putter grip with the right and left hands supinated according to an embodiment.

In order to adjust grip position on a conventional putter grip, a golfer needs to rotate his or her hand to a different position on the putter grip, resulting in the palm or other parts of the hand to be removed or lack proper contact with the putter grip. For example, FIG. 1 is a top perspective view of a typical neutral grip position of a golfer's hands on a putter grip. FIG. 2 illustrates a grip position of a golfer's hands on a putter grip, wherein the left hand pronated in a clockwise direction with respect to the right hand held in a neutral position. It will be understood that as shown in FIG. 2 the left hand may be pronated or supinated with the right hand held neutral. FIG. 3 illustrates a grip position of a golfer's hands on a putter grip, wherein the right hand is pronated in a counterclockwise direction with respect to the left hand held in a neutral position. It will be understood that as shown in FIG. 3 the right hand may be pronated or supinated with left hand held neutral. FIG. 4 depicts another grip wherein the grip is customized for the golfer by the right and left hand having the ability to be independently pronated and supinated in order to account for anatomical variances of different golfers. The above examples are not intended to be limiting as to the possible grip positions and orientations of a golfer's hands on a putter grip.

Embodiments of the adjustable putter grip allow a user to adjust the putter grip to positions and orientations to allow the golfer to rotate the grip position of a hand independent from the grip position of the other hand to allow for a rotated or twisted grip position while still maintaining contact with the putter grip with the typical parts of the golfer's hands, such as the palm. In other words, the golfer may independently pronate or supinate each hand and adjust the putter grip to match the hand position.

Figure 5:
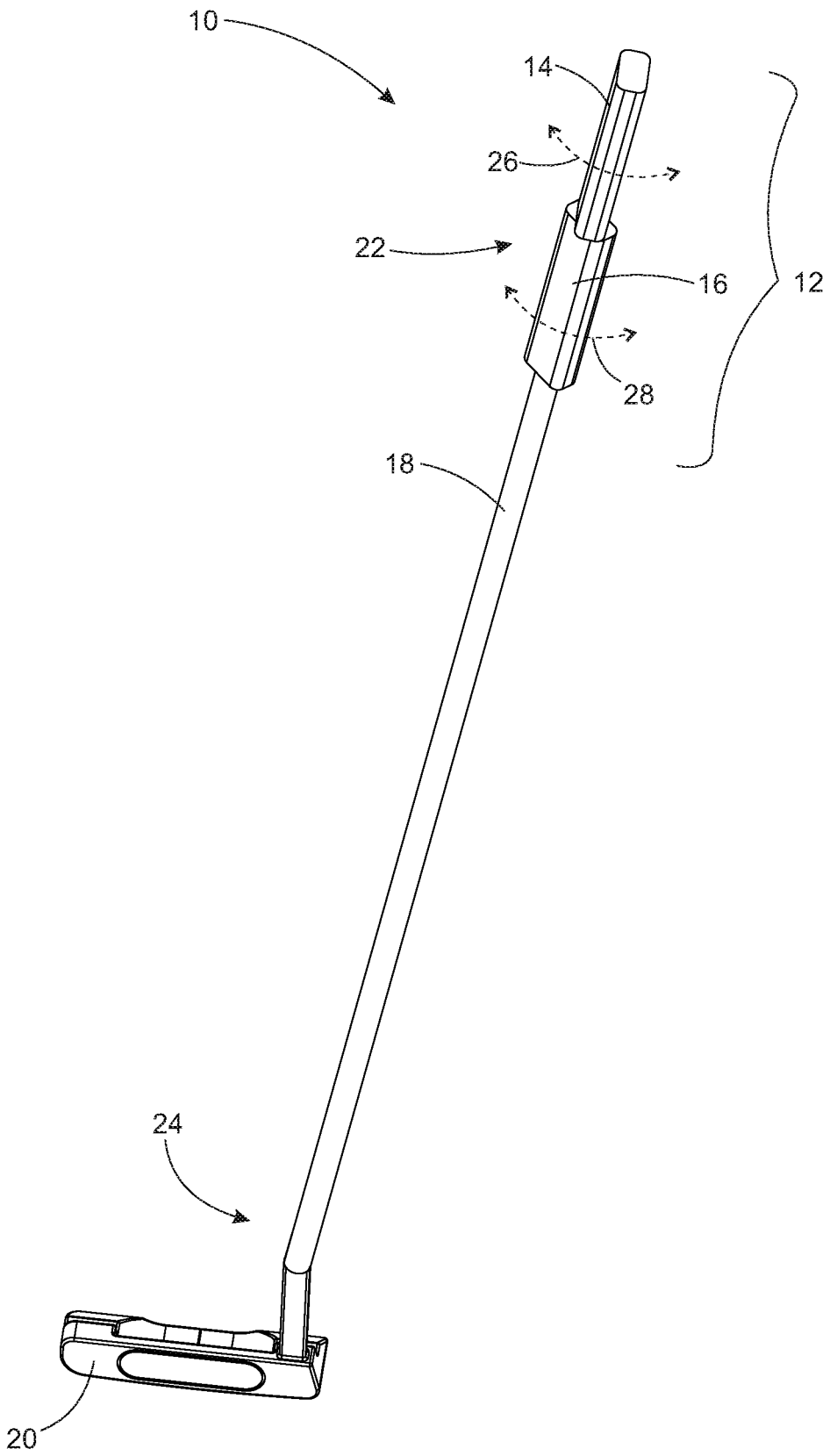
FIG. 5 is a perspective view of a putter with an adjustable putter grip according to an embodiment.
Figure 6C:
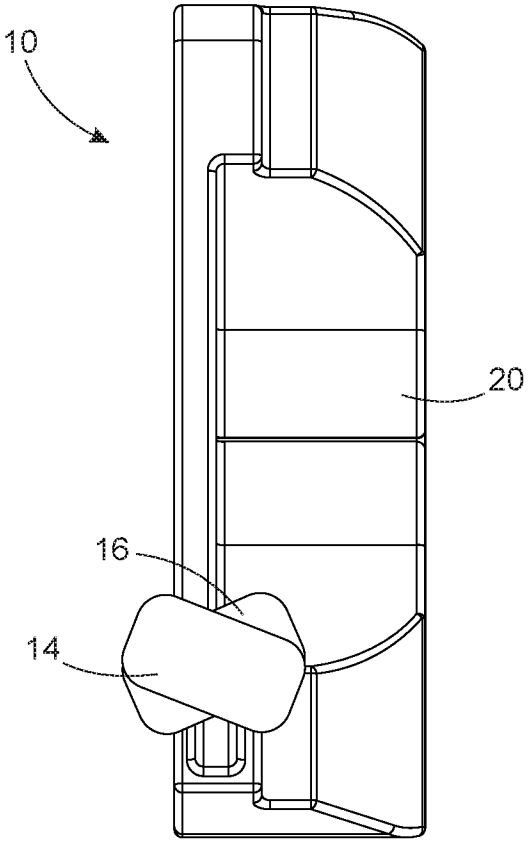
FIG. 6C is yet another top view of a putter with an adjustable putter grip according to an embodiment.
Figure 6B:
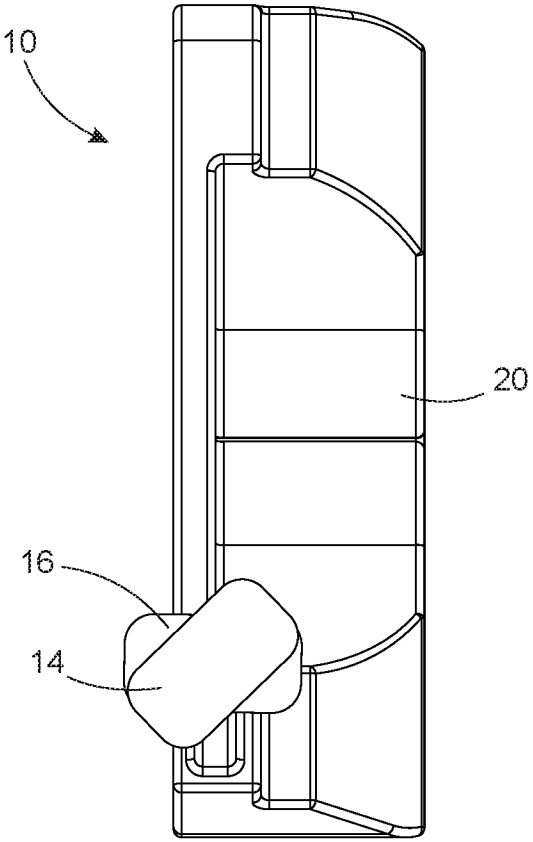
FIG. 6B is another top view of a putter with an adjustable putter grip according to an embodiment.
Figure 6A:
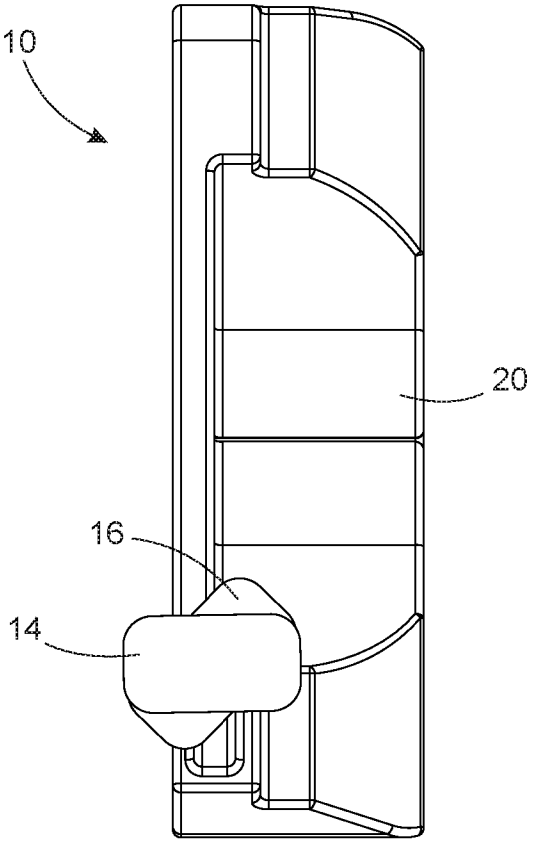
FIG. 6A is a top view of a putter with an adjustable putter grip according to an embodiment.

Embodiments, as depicted in FIG. 5 include a putter 10 with an adjustable putter grip 12 having a first grip member 14 and a second grip member 16. Embodiments of the putter grip 12 allow for a variety of advanced hand positions for the putter stroke. This is generally accomplished through a variable-position grip assembly 12 surrounding the putter shaft 18. The grip 12 is split into a first grip member 14 and a second grip member 16. In some embodiments, one grip member 14 or 16 may rotate while the other remains stationary, while in other embodiments, each grip member 14 and 16 may be selectively rotated relative to one another around the shaft 18 to orient in particular positions that enable the golfer to grasp the putter in an optimal and consistent manner. The adjustable putter grip 12 may include a securing device to secure or lock the first and second grip members 14 and 16 into the desired or selected orientation. The result is that the putter head 20 will more likely strike a golf ball at a substantially consistent angle during successive strokes.

Figure 7:
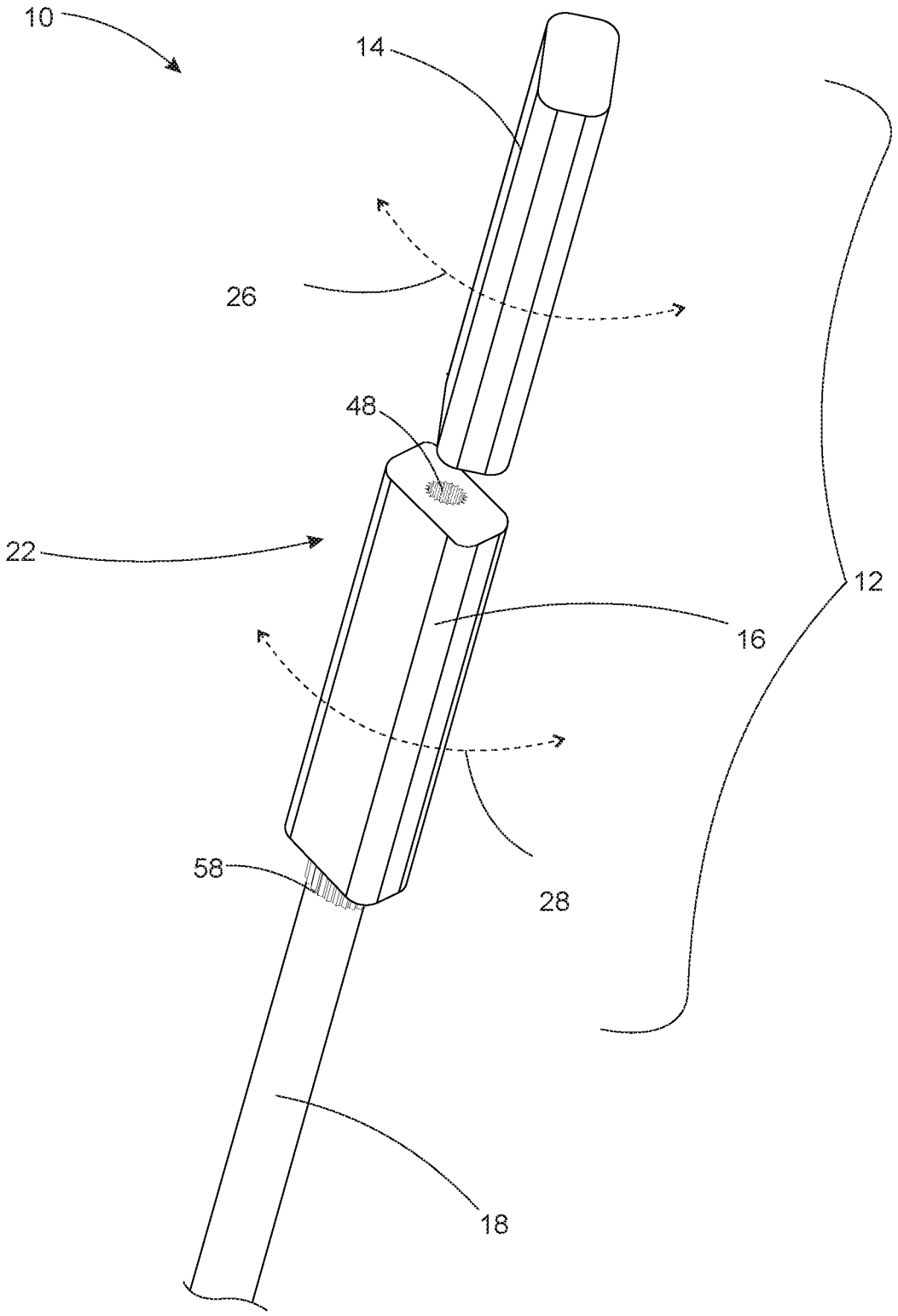
FIG. 7 is an exploded view of a putter shaft with the putter grip members adjusting according to an embodiment.
Figure 8:
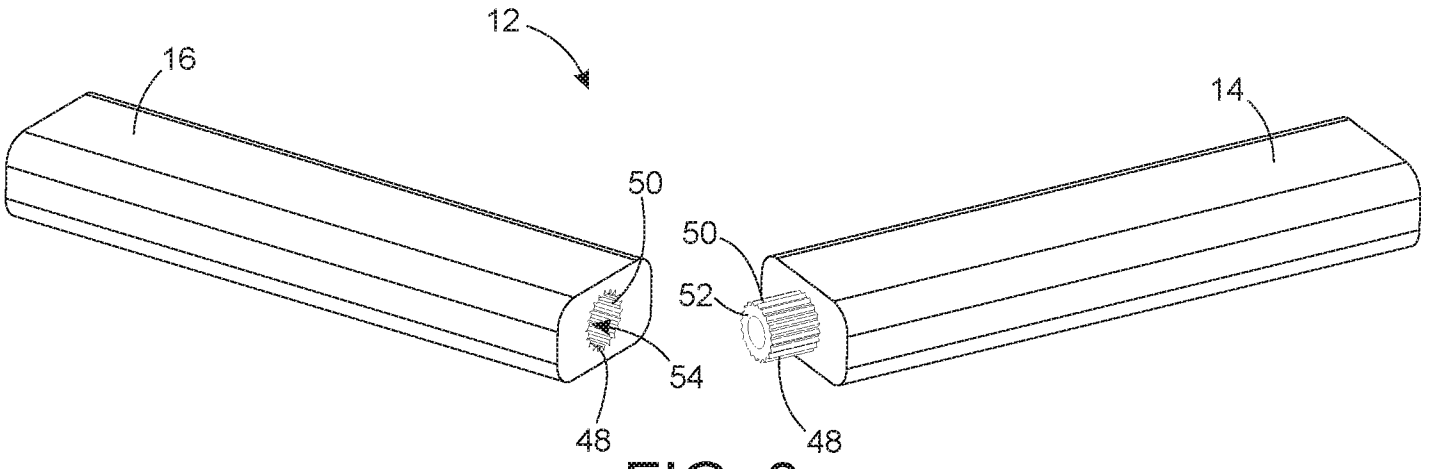
FIG. 8 is an exploded view of an adjustable putter grip according to an embodiment.
Figure 9:
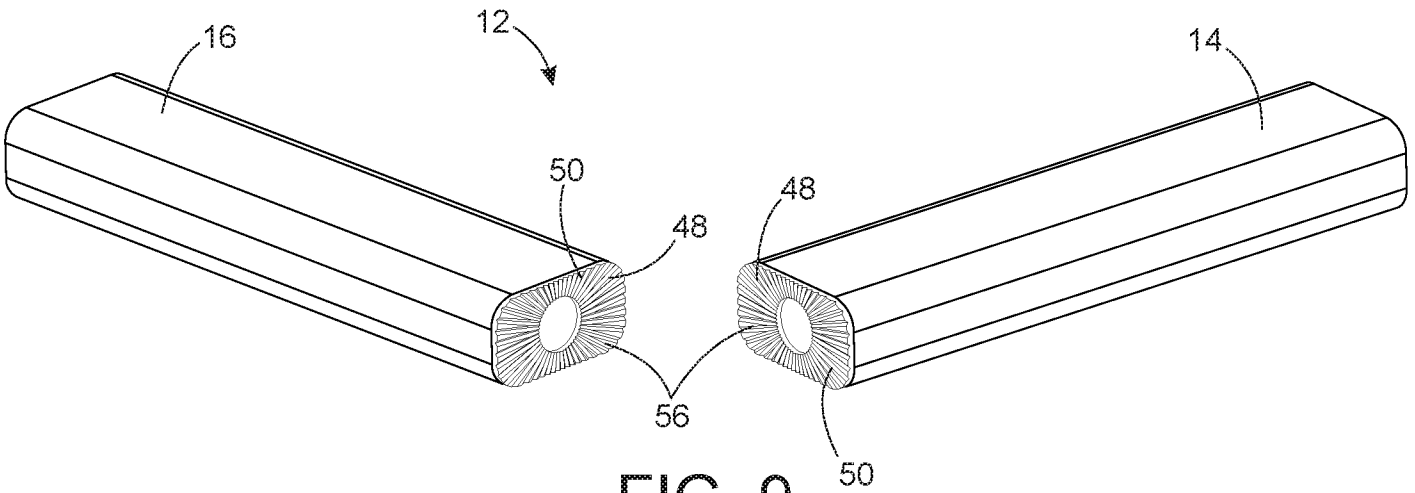
FIG. 9 is an exploded view of an adjustable putter grip according to another embodiment.

In some embodiments, depicted in FIGS. 7-9, the first and second grip members 14 and 16 are connected to each other and to the shaft 18 by teeth of respective spline sets that can easily be moved between detached and locked engagements. In these embodiments, the shaft and the grip members 14 and 16 may be separated from each other and then connected using the teeth to respective spline sets to orient the first and second grip members 14 and 16 in the user-defined orientation. The ease of detaching and altering the grip allows any user to customize his or her grip on the fly, or at any time, to accommodate the wrist angle the golfer finds most comfortable or consistent, so that the putter head 20 will strike the golf ball at a generally consistent angle during successive strokes.

In some embodiments, as shown in FIG. 8, the first grip member 14 comprises a male splined protrusion 52 and the second grip member 16 comprises a female splined recess 54, such that the male splined protrusion 52 and the female splined recess 54 may engage each other to prevent the first grip member 14 from rotating with respect to the second grip member 16. In some embodiments, the second grip member 16 comprises a male splined protrusion that may engage a female splined recess of the first grip member 14. The splines shown in FIG. 8 is an embodiment of the securing device.

In some embodiments, as shown in FIG. 9, the first and second grip members 14 and 16 each comprise a splined end surface 56, such that the splined end surfaces 56 of the first and second grip members 14 and 16 may engage each other to prevent the first grip member 14 from rotating with respect to the second grip member 16.

In some embodiments, shown in FIGS. 7-9, the putter shaft 18 comprises a spline set 50 having teeth that extend radially outward from the surface thereof. The first grip member 14 comprises a female splined recess 54 and the second grip member 16 comprises a splined aperture extending lengthwise through the second grip member, the female splined recess 54 and the splined aperture each having teeth 48 that extend radially inward from the inner surfaces thereof and engage the spline set 50 of the putter shaft when the first grip member 14 and second grip member 16 are coupled, either removably or permanently, to the putter shaft 18, such that the first grip member 14 and the second grip member 16 are prevented from rotating relative to the putter shaft 18. The splines shown in FIGS. 7-9 are embodiments of the securing device.

Although the teeth 48 of the spline sets 50, shown in FIGS. 7-9, are of substantially triangular shape, this is not intended to be limiting. The teeth 48 of the spline sets 50 may be of any suitable shape, such as substantially rectangular, fluted, or of any other shape that is suitable for use as teeth of a spline set. Further, the teeth 48 of a spline set 50 may be any protrusions of any shape that are suitable to engage any recesses of a corresponding spline set 50 of corresponding shape known to a person of ordinary skill in the art.

As shown in FIG. 5, the first grip member 14 is coupled adjacent a first end 22 of a putter shaft 18, wherein the putter head 20 is coupled to the second end 24 of the putter shaft 18. The second grip member 14 is coupled to the putter shaft 18 between the first grip member 14 and the second end 24 of the putter shaft 18. The first grip member 14 and/or the second grip member 16 may rotate about the shaft 18 in either direction as depicted by arrows 26 and 28 respectively. By so doing, the user can adjust the grip position of each hand independently.

Embodiments may include a locking collar (not shown) that surrounds the shaft 18 and slides axially along the shaft 16 into engagement with the grip assembly 12 to prevent the rotation of the first and second grip members 14 and 16 around the shaft 18 while putting. The locking collar is an embodiment of the securing device and may be locked or secured in a locked position by any means suitable to secure a grip member to a putter shaft, such as by a set pin, a set screw, a lock pin, a clamping lever, a threaded nut, an axial clamp, and the like. Further, this becomes a partial equipment answer to having the hands of a user feel more comfortable. Further still, embodiments allow the golfer to pronate or supinate his or her hands in matching symmetry and further allows the golfer to pronate or supinate his or her hands independently to account for anatomical variances between each golfer.

In some embodiments, the first and second grip members 14 and 16 each comprise a locking collar that may be coupled to or which forms an integral part of the grip member. The locking collar may be locked or secured in a locked position by any means suitable to secure the grip member to a putter shaft, such as by a set pin, a set screw, a lock pin, a clamping lever, a threaded nut, an axial clamp, and the like, such that a user may easily adjust the orientation of each grip member independently on the fly, or at any time, by unlocking the locking collar, turning the grip member to the desired orientation, and then locking the locking collar.

It will be understood that while splines and a locking collar are shown as embodiments of a securing device, other securing devices may be used. Accordingly, any type of securing device may be used, so long as the securing device secures the first and second grip members 14 and 16 in the desired orientation.

In embodiments, the shaft of the club could also move by itself or the grip members can move independently around the shaft. Grip members may also not move at all, wherein the manufacturer may apply the grip members to the shaft at the desired orientations. Other embodiments, as discussed above, may be adjusted either by a user or by a factory before sale.

Embodiments may be available on or through the internet, such as through domain names reserved and owned by Applicant that include flexputt.com, adjustablegrips.com, freehandgolf.com, freehandgrip.com, freeputt.com, freehandputting.com, or the like.

Accordingly, the components defining any adjustable putter grip may be formed of any of many different types of materials or combinations thereof that can readily be formed into shaped objects provided that the components selected are consistent with the intended operation of an adjustable putter grip. For example, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any adjustable putter grip may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

Figure 10:
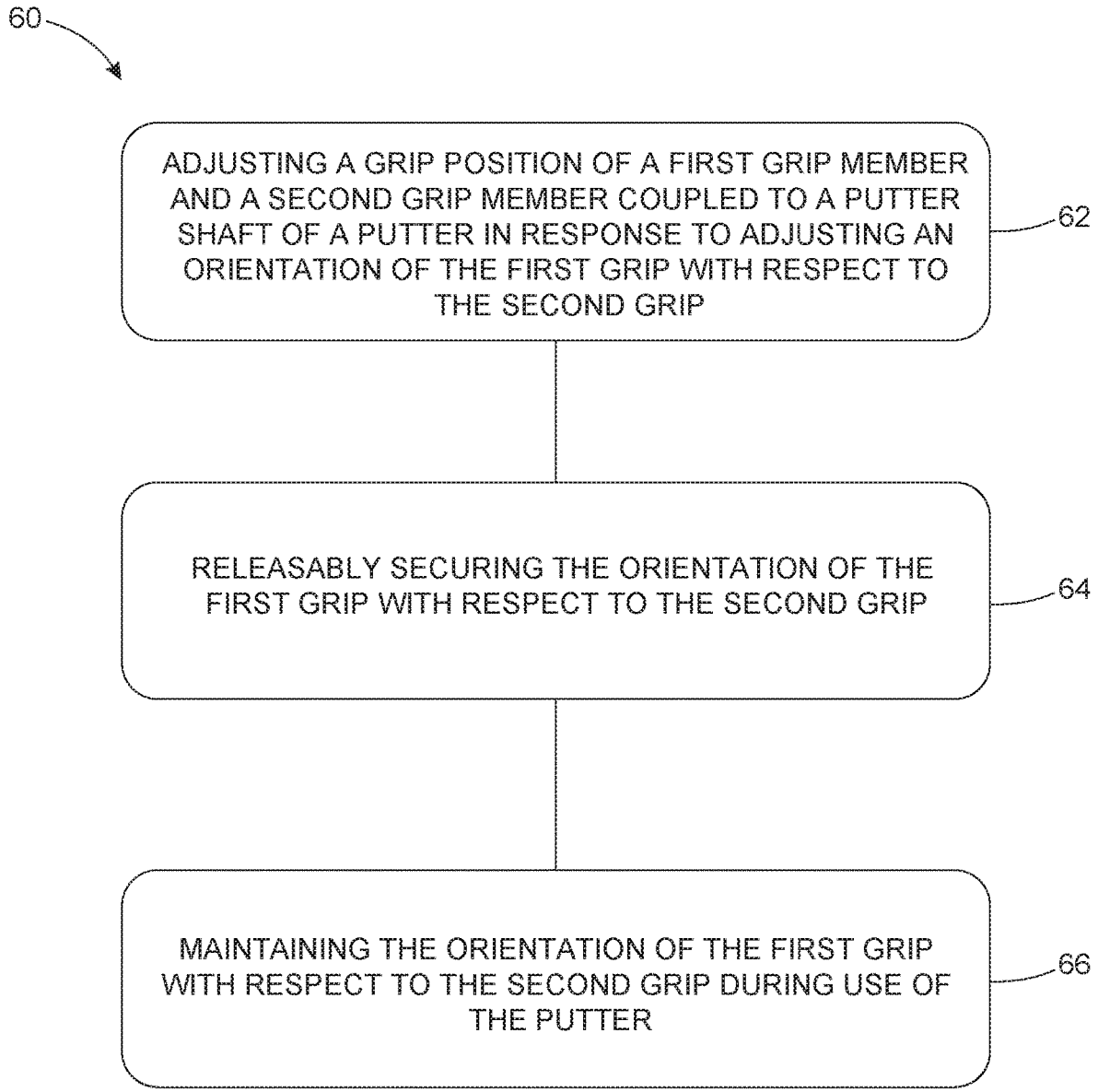
FIG. 10 is a flow diagram representing steps of a method of use of an adjustable putter grip.
Figure 11A:
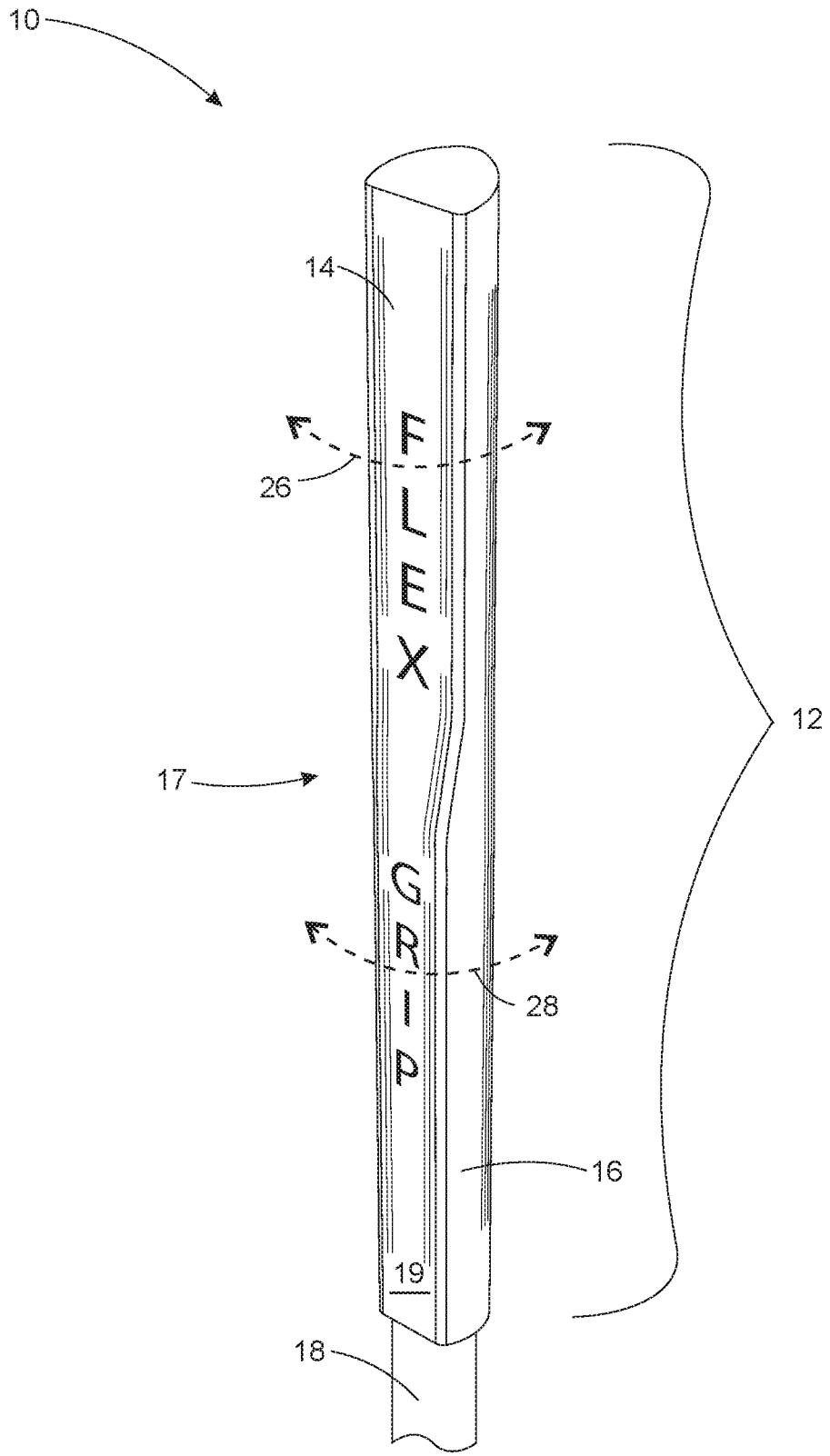
FIG. 11A is a perspective view of an adjustable putter grip according to an embodiment.
Figure 11B:
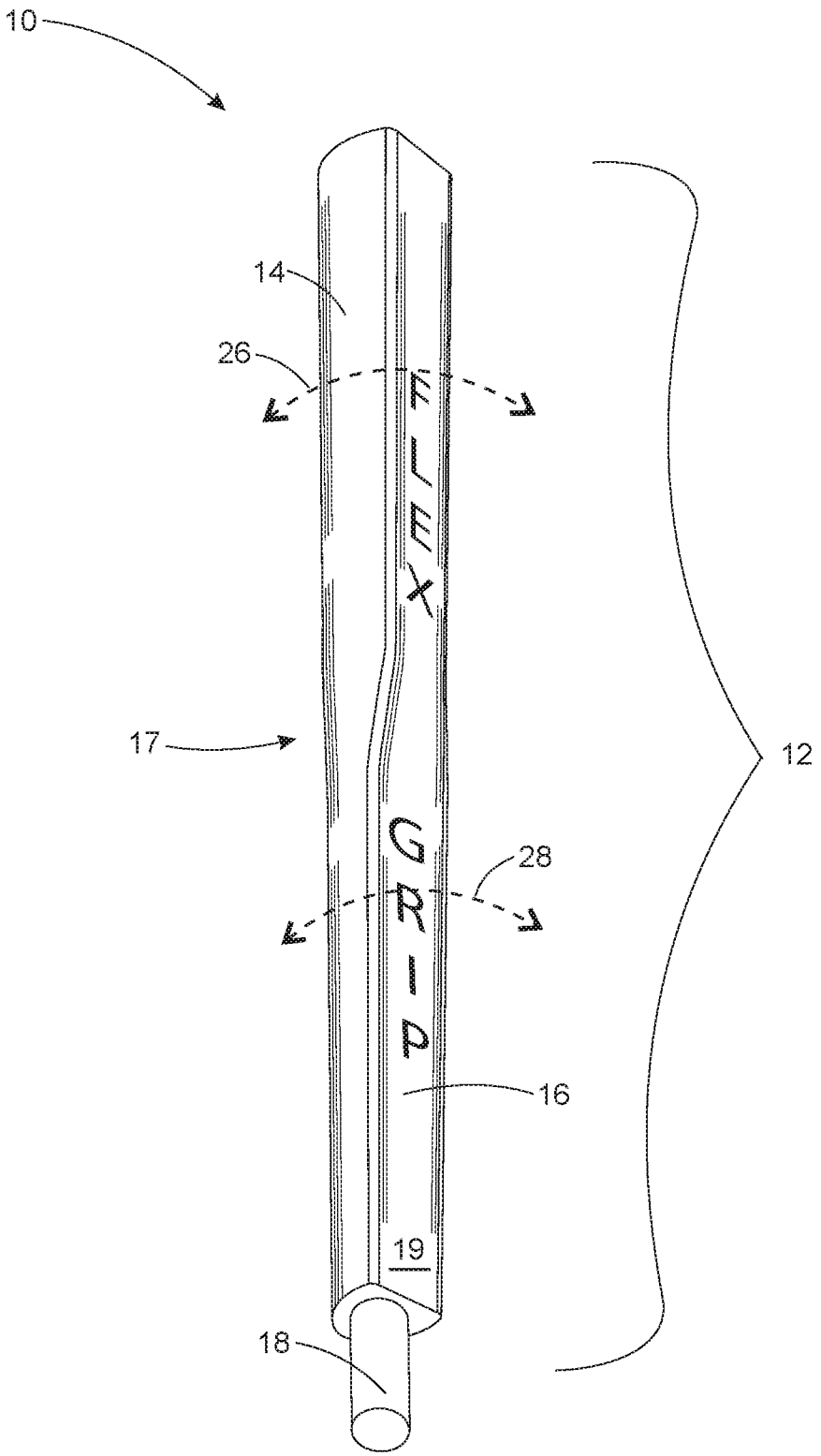
FIG. 11B is a perspective view of an adjustable putter grip according to an embodiment.
Figure 11C:
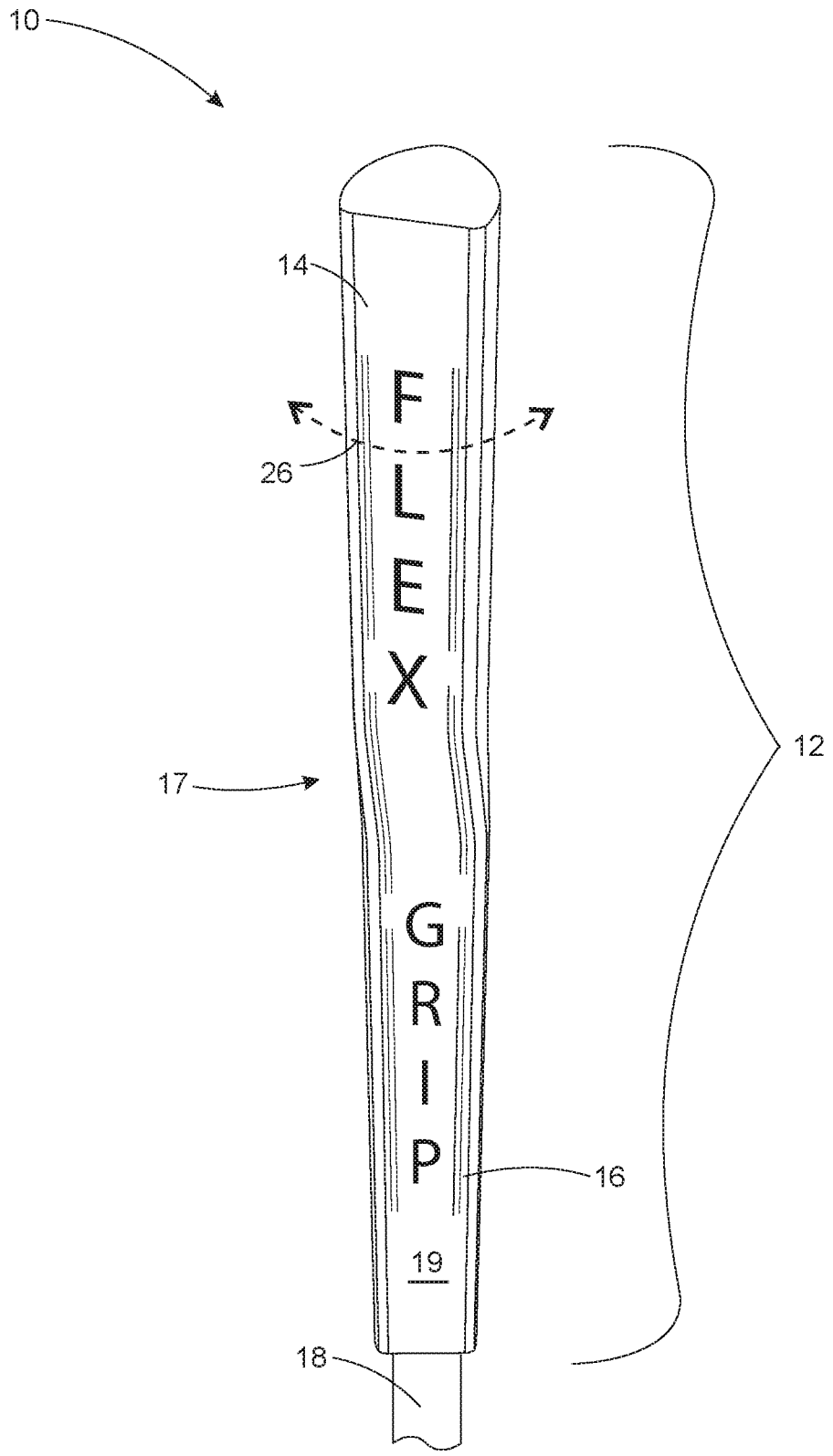
FIG. 11C is another perspective view of an adjustable putter grip according to an embodiment.
Figure 11D:
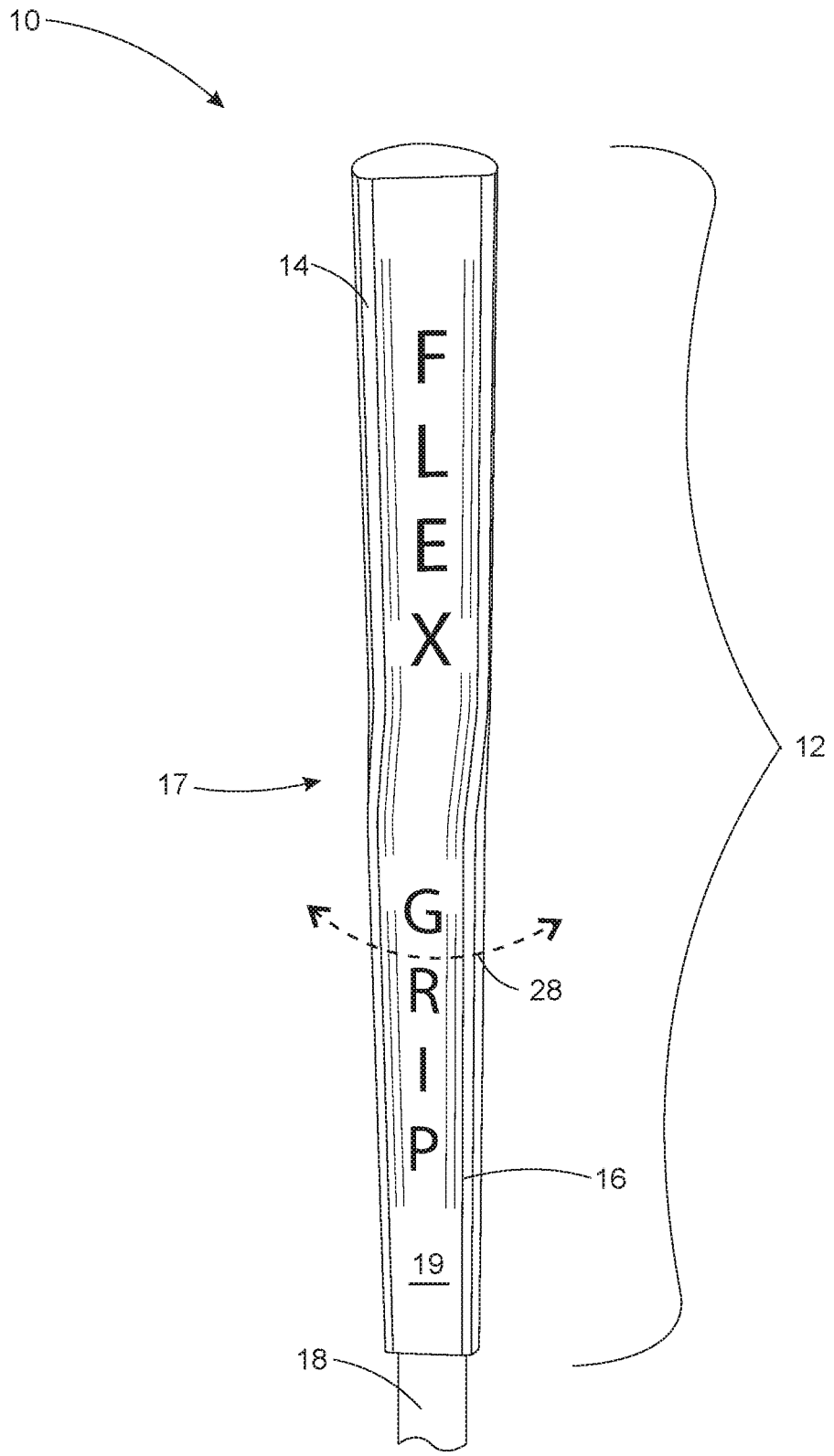
FIG. 11D is a further perspective view of an adjustable putter grip according to an embodiment.

Referring to FIG. 10, a block diagram of a method 60 of use of an adjustable putter grip is depicted. The method 60 comprises adjusting a grip position of a first grip member and a second grip member coupled to a putter shaft of a putter in response to adjusting an orientation of the first grip with respect to the second grip (Step 62); releasably securing the orientation of the first grip with respect to the second grip (Step 64); and maintaining the orientation of the first grip with respect to the second grip during use of the putter (Step 66).

Step 62 of adjusting the orientation of the first grip member with respect to the second grip member may further include rotation of first grip member and the second grip member about the putter shaft. Alternatively, Step 62 of adjusting the orientation of the first grip member with respect to the second grip member may include rotation of the first grip member about the putter shaft while the second grip member is fixed to the putter shaft. Alternatively, Step 62 of adjusting the orientation of the first grip member with respect to the second grip member may include rotation of the second grip member about the putter shaft while the first grip member is fixed to the putter shaft.

The securing of the orientation of the first grip member with respect to the second grip member in Step 64 may include any useable securing means, such as that described above with regard to splines or locking collars. Other means and devices are contemplated without departing from the scope of the present invention.

According to embodiments, as shown in FIGS. 11A-11D, a method of forming a custom grip or custom fitting of a golfer is provided. The method may include independently pronating or supinating portions of a putter grip in a desired position for holding by the golfer's hands; forming a customized single grip corresponding to the desired position of the golfer's hands; and maintaining a fixed customized grip on a shaft of a putter. In these embodiments, either hand may be held in a neutral position while the other hand is pronated or supinated or, in another embodiment, both hands may be pronated and supinated independently and simultaneously. In at least this way, embodiments of the invention may be used for custom adjustments or fitting.

Independently pronating and supinating portions of the putter grip may include one of: the golfer rotating a first portion 14 and a second portion 16 of the putter grip 12 in any direction displayed by arrows 26 and 28 respectively, with a twist point 17 located between the first and second portions 14 and 16 (see FIGS. 11A-11B); the golfer rotating a first portion 14 in any direction displayed by arrow 26 while a second portion 16 is held in a neutral position, with a twist point 17 located between the first and second portions 14 and 16 (see FIG. 11C); or the golfer rotating a second portion 16 in any direction displayed by arrow 28 while a first portion 14 is held in a neutral position, with a twist point 17 located between the first and second portions 14 and 16 (see FIG. 11D), such that the first and second portions of the grip 12 are positioned in a golfer-determined position at customized angles of rotation. The putter grip 12 may include a unitary grip cover 19 with malleable material interior to the unitary grip cover 19 to form the first and second grip members 14 and 16. Once the golfer determines the angles of the first and second putter grip members 14 and 16, they may be set or otherwise be secured in the golfer-defined position as a way of forming the customized grip. In some embodiments, the customized grip includes fixing the first and second grip members 14 and 16 in a configuration wherein they cannot be moved again.

Figure 12:
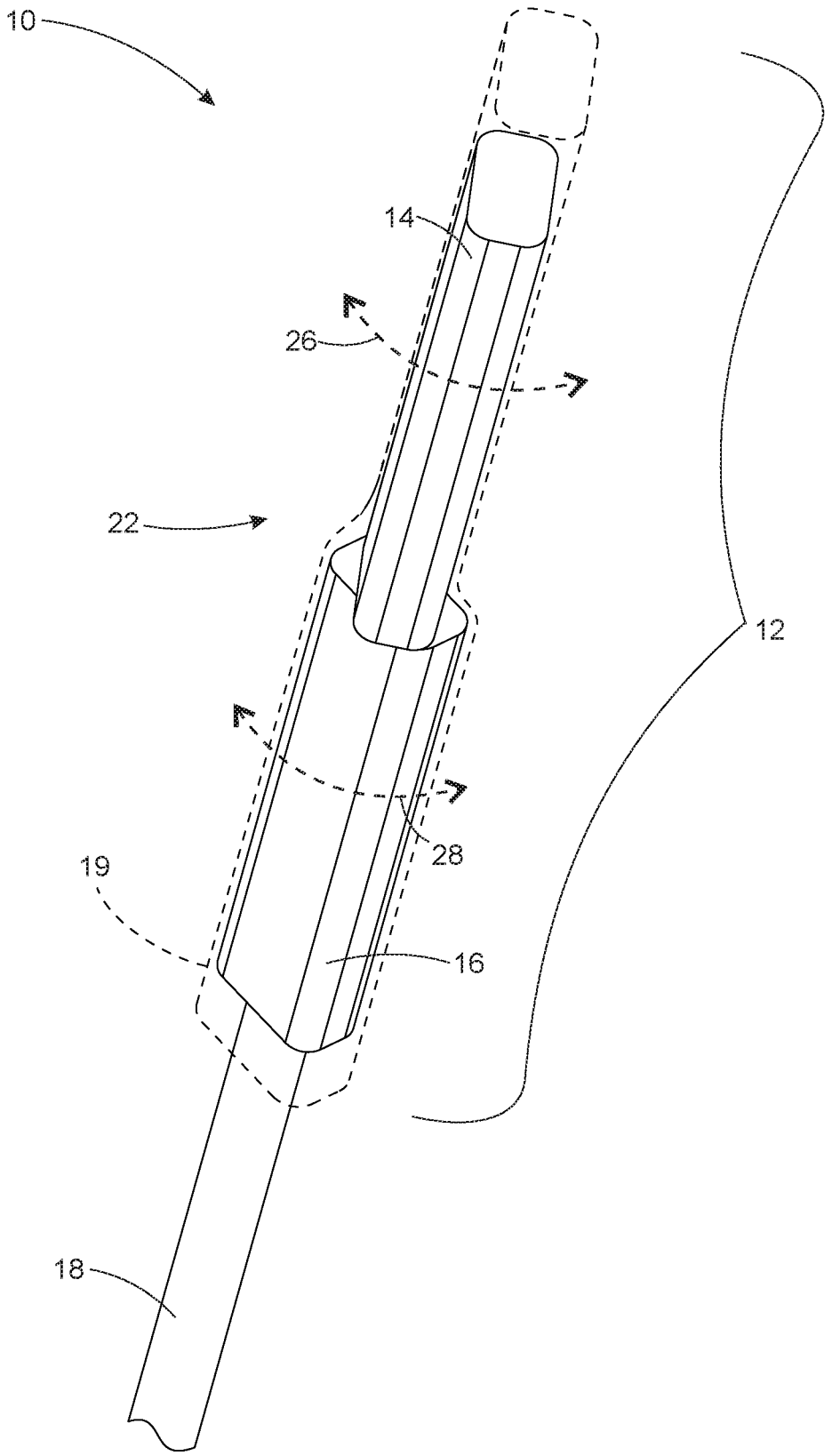
FIG. 12 is a perspective view of an adjustable putter grip with the outer grip member see through to see optional inner components according to an embodiment.

In some embodiments, as shown in FIG. 12, the first and second members 14 and 16 may be structural elements, as discussed with respect to FIGS. 1-9, within the grip cover 19. The putter grip 12 may then be maintained on the putter shaft 18 for the golfer to utilize during putting. In some embodiments, the customized grip includes fixing the first and second grip members 14 and 16 in a configuration wherein they cannot be moved again.

It should be appreciated that in all embodiments of the present invention, the putter shaft 18, at all times, is maintained in a straight configuration and is not bent or twisted in any way, and embodiments are directed to the inventive putter grip only.

The embodiments and examples set forth herein were presented in order to best explain the present invention and its practical application, and to thereby enable those of ordinary skill in the art to make and use the invention. However, those of ordinary skill in the art will recognize that the foregoing description and examples have been presented for the purposes of illustration and example only. The description, as set forth, is not intended to be exhaustive or to limit the invention to the precise form disclosed. Many modifications and variations are possible, in light of the teachings above, without departing from the spirit and scope of the forthcoming claims.

The invention claimed is:

1. An adjustable customized putter grip comprising:
- a unitary grip cover;
- a first grip member coupled within a first portion of the unitary grip cover;
- a second grip member coupled within a second portion of the unitary grip cover; and
- a twist point coupled between the first grip member and the second grip member, wherein:
  - the first grip member and the second grip member are rotated with respect to each other utilizing the twist point to a golfer-determined orientation at customized angles of rotation, wherein the unitary grip cover is deformed in response to rotation of the first grip member and the second grip member with respect to each other, wherein the first portion of the unitary grip cover is rotated with respect to the second portion of the unitary grip cover at an angle of rotation corresponding to the angle of rotation between the first grip member and the second grip member; and
  - the first grip member, the second grip member and the twist point are coupled to a shaft of a putter and the first grip member, the second grip member and the twist point are secured in the golfer-determined orientation, wherein the first grip member, the second grip member, and the twist point are completely contained within the unitary grip cover.

2. The grip of claim 1, wherein the first grip member, the second grip member and the twist point are secured in the golfer-determined orientation prior to coupling to the putter shaft.

3. The grip of claim 1, wherein the first grip member, the second grip member and the twist point are secured in the golfer-determined orientation after coupling to the putter shaft.

4. An adjustable customized putter grip comprising:
- a unitary grip cover formed of a malleable material;
- a first grip member coupled within a first portion of the unitary grip cover;
- a second grip member coupled within a second portion of the unitary grip cover; and
- a twist point coupled between the first grip member and the second grip member, wherein:
  - the first grip member, the second grip member and the twist point are coupled to a shaft of a putter, wherein the first grip member, the second grip member, and the twist point are completely contained within the unitary grip cover; and the first grip member and the second grip member are rotated with respect to each other utilizing the twist point to a golfer-determined orientation at customized angles of rotation and the first grip member, the second grip member and the twist point are secured in the golfer-determined orientation, wherein the unitary grip cover is deformed in response to rotation of the first grip member and the second grip member with respect to each other, wherein the first portion of the unitary grip cover is rotated with respect to the second portion of the unitary grip cover at an angle of rotation corresponding to the angle of rotation between the first grip member and the second grip member.

5. An adjustable putter grip comprising:

a unitary grip cover formed of a malleable material;

a first grip member coupled adjacent a first end of a putter shaft within a first portion of the unitary grip cover, wherein a putter head is coupled to a second end of the putter shaft;

a second grip member coupled to the putter shaft in a position between the first grip member and the second end of the putter shaft within a second portion of the unitary grip cover, wherein an orientation of the first grip member with respect to the second grip member is adjustable to adjust a grip position; and a securing device for securing the first grip member and the second grip member in a desired orientation, wherein the securing device includes the first grip member comprising a first portion of the securing device and the second grip member comprising a second portion of the securing device, wherein the first portion of the securing device engages and disengages the second portion of the securing device, to maintain the orientation of the first grip member with respect to the second grip member when engaged, and allow rotation of the first grip member and the second grip member with respect to each other when disengaged, wherein the first grip member, the second grip member, and the securing device are completely contained within the unitary grip cover, wherein the unitary grip cover is deformed in response to rotation of the first grip member and the second grip member with respect to each other, wherein the first portion of the unitary grip cover is rotated with respect to the second portion of the unitary grip cover at an angle of rotation corresponding to the angle of rotation between the first grip member and the second grip member.

* * * * *